US006853276B2

(12) United States Patent
Smith

(10) Patent No.: US 6,853,276 B2
(45) Date of Patent: Feb. 8, 2005

(54) ELECTROMAGNETIC FORMED CONTACT SURFACE

(76) Inventor: Richard G. Smith, 28 Monroe, North Aurora, IL (US) 60542

( * ) Notice: Subject to any disclaimer, the term of this patent is extended or adjusted under 35 U.S.C. 154(b) by 9 days.

(21) Appl. No.: 09/957,139

(22) Filed: Sep. 20, 2001

(65) Prior Publication Data

US 2003/0052760 A1 Mar. 20, 2003

(51) Int. Cl.[7] ..... H01H 67/02
(52) U.S. Cl. ..... 335/132; 335/281
(58) Field of Search ..... 335/132, 202, 335/151–256, 276–82, 296, 220–229; 336/178

(56) References Cited

U.S. PATENT DOCUMENTS 3,546,571 A * 12/1970 Fletcher et al. ..... 336/178
4,577,174 A * 3/1986 Lemmer ..... 335/261
5,435,343 A * 7/1995 Buezis ..... 251/129.15
5,623,239 A * 4/1997 Sitar ..... 335/132
6,232,864 B1 * 5/2001 Hosozawa et al. ..... 336/178

* cited by examiner

*Primary Examiner*—Lincoln Donovan

(57) ABSTRACT

An electromagnetically actuable device includes a base. A magnetic core is fixedly mounted to the base. An armature is movably mounted to the base proximate the magnetic core. A coil is fixedly mounted to the base and is selectively energized to draw the armature to the magnetic core. The armature and magnetic core have mating surfaces adapted to provide three contact areas in a triangular configuration to provide minimal magnetic air gap and a stable interface when the coil is energized.

20 Claims, 4 Drawing Sheets

ELECTROMAGNETIC FORMED CONTACT SURFACE

TECHNICAL FIELD OF THE INVENTION

This invention relates to electromagnetically actuable devices and, more particularly, to electromagnet formed contact surfaces.

BACKGROUND OF THE INVENTION

A conventional electromagnetically actuable device has a magnetic core proximate an armature. A coil is selectively energized to draw the armature to the magnetic core. The device may be a solenoid, a contactor, a motor starter, or the like. The armature is operatively associated with a movable device such as movable contacts or an actuator. In many instances the coil is selectively energized from an AC power source. With AC-operated electromagnets, elimination or control of noise is a prime concern. To minimize noise the surface interface of the magnetic core and armature of each device must be matched to provide minimal magnetic "air gap" and a stable interface surface. The minimal air gap assures sufficient force to prevent movement and the stable surface interface prevents movements due to the widely changing forces in the AC-operated device. Particularly, a spring provides a constant force between the magnetic core and the armature. Energization of the coil counteracts the spring force to draw the armature toward the magnetic core. However, with an AC power source operating at, for example, 60 Hz, there are 120 zero crossings each second during energization. This in combination with other variations in contact surfaces can produce a noisy device.

A conventional approach to minimizing noise has been to grind all interfacing magnetic surfaces. This is a costly operation which must be done within tight limits and can have poor results. Small warping of either magnetic part can still result in an unstable and thus noisy electromagnet.

SUMMARY OF THE INVENTION

In accordance with the invention, an electromagnetically actuable device has electromagnets with formed contact surfaces to minimize noise.

Broadly, there is disclosed herein an electromagnetically actuable device having a magnetic core proximate an armature and a coil selectively energized to draw the armature to the magnetic core. The device comprises the armature and magnetic core having mating surfaces adapted to provide three contact areas in a triangular configuration to provide minimal magnetic air gap and a stable interface when the coil is energized.

In one aspect of the invention the mating surface of the magnetic core is planar and the mating surface of the armature includes three raised areas defining the three contact areas.

In another aspect of the invention the mating surface of the armature is planar and the mating surface of the magnetic core includes three raised areas defining the three contact areas.

In accordance with still a further aspect of the invention the mating surface of the armature includes three raised areas and the mating surface of the magnetic core includes three raised areas opposite the armature's three raised areas to define the three contact areas.

It is a feature of the invention that the magnetic core and the armature are formed of laminated magnetic steel. The laminations in one of the magnetic core and the armature are shifted relative to one another to provide the three contact areas.

In accordance with one aspect of the invention, the three contact areas are rounded.

In accordance with another aspect of the invention the three contact areas are generally pointed.

It is a feature of the invention that the depth of the contact areas is less than about 0.003 inches to provide the minimal magnetic air gap and the stable interface when the coil is energized.

It is still another feature of the invention that the depth of the contact area is about 0.002 inches to provide the minimal magnetic air gap and the stable interface when the coil is energized.

There is disclosed in accordance with a further aspect of the invention an electromagnetically actuable device including a base. A magnetic core is fixedly mounted to the base. An armature is movably mounted to the base proximate the magnetic core. A coil is fixedly mounted to the base and is selectively energized to draw the armature to the magnetic core. The armature and magnetic core have mating surfaces adapted to provide three contact areas in a triangular configuration to provide minimal magnetic air gap and a stable interface when the coil is energized.

Further features and advantages of the invention will be readily apparent from the specification and from the drawings.

DETAILED DESCRIPTION OF THE INVENTION

Figure 1:
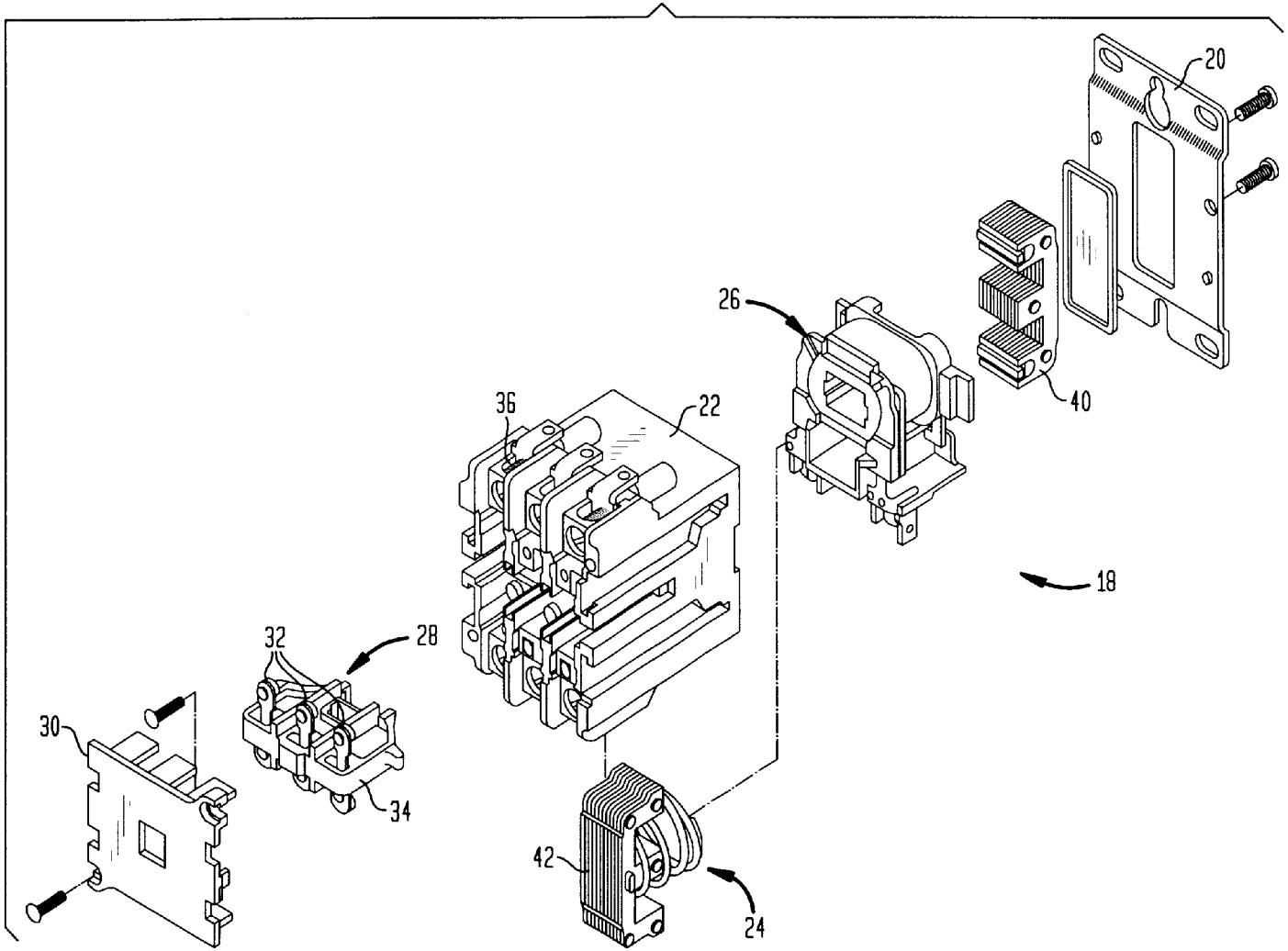
FIG. 1 is an exploded, perspective view of an electromagnetically actuable device in the form of a contactor including an electromagnet in accordance with the invention.

Referring initially to FIG. 1, an electromagnetically actuable device in the form of an electrical contactor 18 is illustrated in exploded form. The contactor 18 includes a base 20, a housing 22, an electromagnet 24, a coil 26 an actuator assembly 28 and a cover plate 30. The electromagnet 24 includes a magnetic core 40 and an armature 42. The housing 22 is mounted to the base and encloses the coil 26 and the magnetic core 40. The magnetic core 40 is fixedly mounted in the housing 22. The magnetic core 40 is made of laminated magnetic steel, as is well known. The coil 26 includes a conventional bobbin, winding and terminal assembly and is located within the housing 22 and on the magnetic core 40. The armature 42 is also of laminated magnetic steel and is associated with movable contacts 32 carried on a contact carrier 34 moveable mounted in the housing 22. The housing 22 also supports stationary contacts 36 positioned in proximity with the moveable contacts 32.

When the coil 26 is energized, the movable armature 42 is drawn toward the magnetic core 40 in a conventional manner. The movement of the armature 42 toward the magnetic core 40 causes the moveable contacts 32 to selectively open or close an electrical circuit with the stationary contacts 36, as is known.

While this application illustrates an electromagnetically actuable device in the form of a contactor, the teachings of the invention can similarly be applied to other electromagnetically actuable devices such as AC solenoids, electromagnetic actuators, motor starters, or the like.

In accordance with the invention, an electromagnet has mating surfaces adapted to provide three contact areas in a triangular configuration, as described below, to provide minimal magnetic air gap and a stable interface when the coil 26 is energized.

Figure 2:
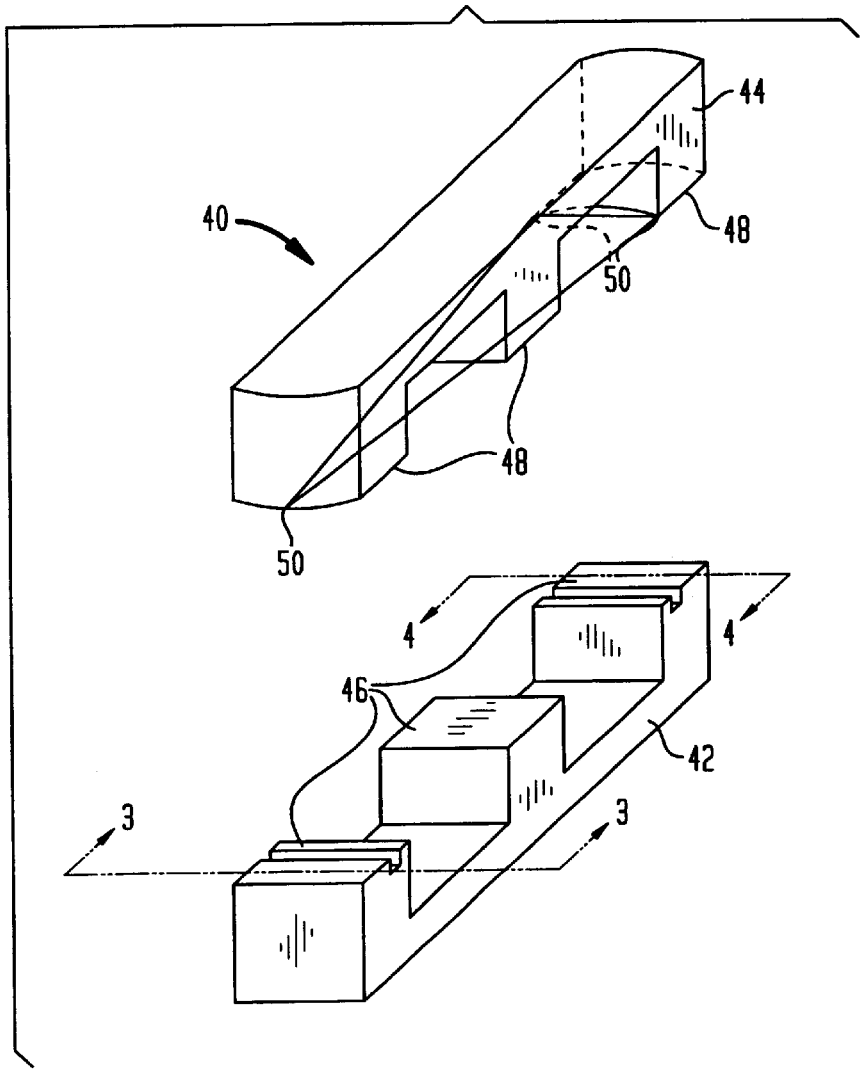
FIG. 2 is an exploded view of an electromagnet in accordance with the invention.

Referring to FIG. 2, the electromagnet 40 is illustrated. The magnetic core 42 and the armature 44 are E-shaped. Similarly, the magnetic core 42 and armature 44 may be of laminated magnetic steel construction. The magnetic core 42 includes legs 43 having mating surfaces 46 which are generally planar. The armature 44 includes legs 45 having mating surfaces 48 which are adapted to provide three contact areas 50 in a triangular configuration as illustrated with a triangle 51 connecting the three contact areas 50. A such, when the coil 26 is energized, the armature 44 is drawn to the magnetic core 42 and the respective mating surfaces 48 and 46 contact one another at only the three contact areas 50. The triangular configuration 51 of the three contact areas 50 provides a tripod-like mating that prevents rocking of the armature 44 relative to the magnetic core 42.

Figure 3:
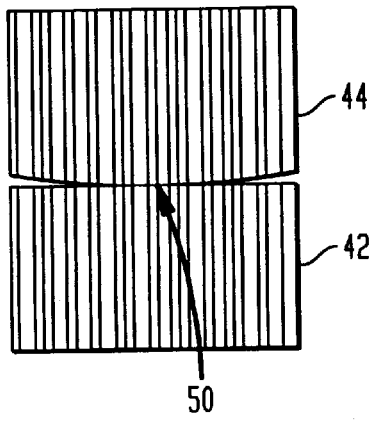
FIGS. 3 and 4 are end views of the electromagnet of FIG. 2 in an energized mode.
Figure 4:
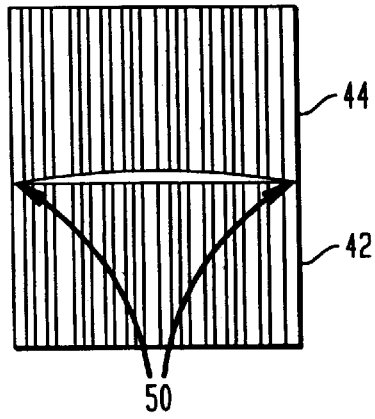

Referring also to FIGS. 3 and 4, the three contact areas are illustrated wherein one of the contact areas 50 is defined by a raised area on one leg of the armature 44, see FIG. 3, while the other two contact areas 50 are formed by raised areas at an opposite end of the armature 44.

The electromagnet 40 is stamped, coined or otherwise formed by stacking or other methods such that a three-point interface is provided. In most configurations, the interface will actually be three lines segments or small areas in a triangular pattern at the interface. This solution eliminates the grinding operation by applying a more stable interface.

For example, a set of forming blocks may be used to shift the form of an armature stack of laminations. The blocks have opposing surfaces to form the lamination stack's active magnetic surface shown in FIG. 2. The form desired has a convex shape at one magnet surface and a concave surface at the other. The resulting interface has a contact area in the center of the adjoining pole surface, see FIG. 3, and two contact areas 50 at the outer edges of the other pole surface, see FIG. 4. The depth of the surface deformations may typically be less than 0.003 inches to minimize losses due to the resulting magnetic air gap. Advantageously, a typical depth of the surface deformations may be about 0.002 inches. As is apparent, the depth is exaggerated in FIGS. 3 and 4 which are not intended to be to scale.

Figure 5:
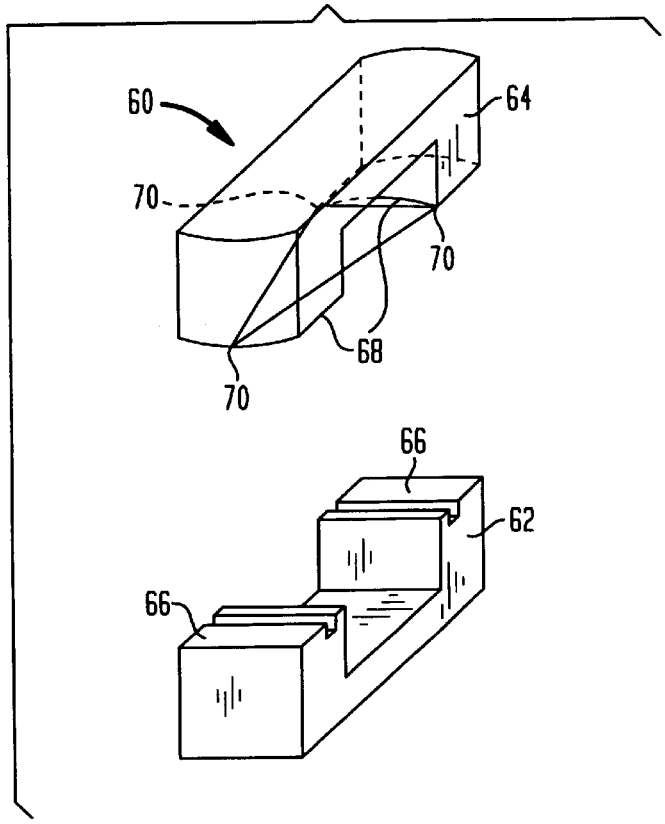
FIG. 5 is an exploded view of another embodiment of an electromagnet in accordance with the invention.

Referring to FIG. 5, an electromagnet 60 having a "C"-shaped magnetic core 62 and armature 64 is illustrated. The magnetic core 62 has legs 63 having planar mating surfaces 66 while the armature 64 has legs 65 having mating surfaces 68 with three raised contact areas 70 in a triangular configuration. as illustrated with a triangle 71 connecting the three contact areas 70. The raised contact areas 70 are similar to the raised contact areas 50 in the embodiment of FIG. 2.

Figure 6:
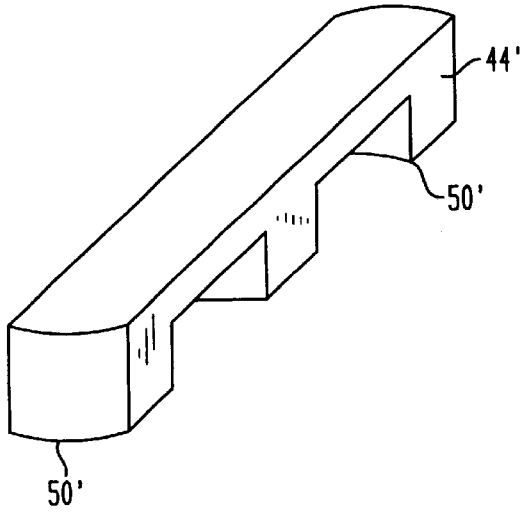
FIG. 6 is a perspective view of an alternative armature for the electromagnet of FIG. 2.
Figure 7:
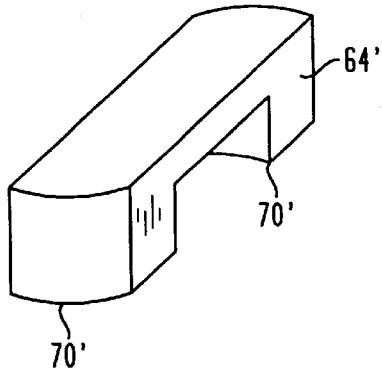
FIG. 7 is a perspective view of an alternative armature for the electromagnet of FIG. 5.

The three contact areas 50 in the embodiment of FIG. 2 and the three contact areas 70 in the embodiment of FIG. 5 may be generally rounded. For example, the contact areas 50 and 70 are defined by a concave arc at one end and a convex arc at the opposite end. Alternatively, the three contact areas could be generally pointed. FIG. 6 illustrates an armature 44□ similar to the armature 44 of FIG. 2, except that raised contact areas 50□ are generally pointed. Similarly, FIG. 7 illustrates an armature 64□ similar to the armature 64 of FIG. 5, including raised contact areas 70□ that are generally pointed. The configuration of the contact areas is determined by the configuration of the forming blocks used, as will be apparent. Alternative shapes would include modifications of arcs and triangles to generally form the contact areas to assure central contact at one pole surface interface and contact at the other pole interface to be a wide interface area or two areas spaced widely apart.

Figure 8A:
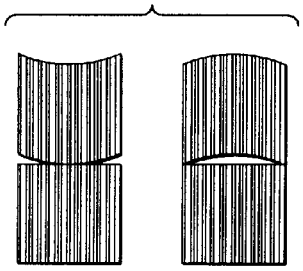
FIGS. 8A–8I are a series of opposite end views of different embodiments of electromagnets in accordance with the invention.
Figure 8B:
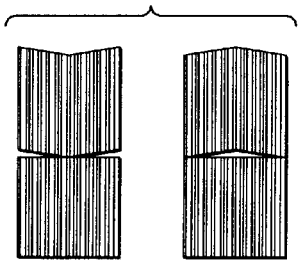
Figure 8C:
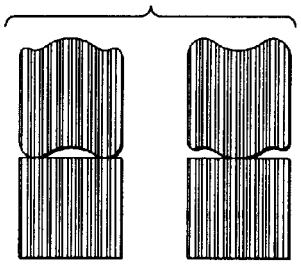
Figure 8D:
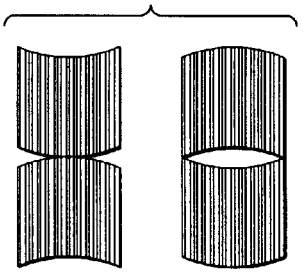
Figure 8E:
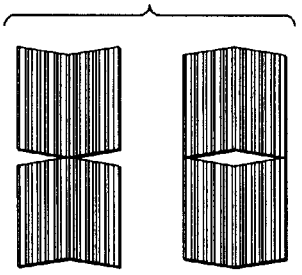
Figure 8F:
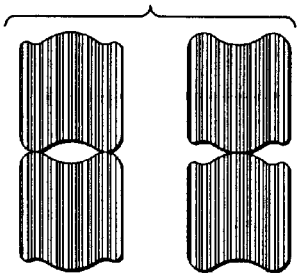
Figure 8G:
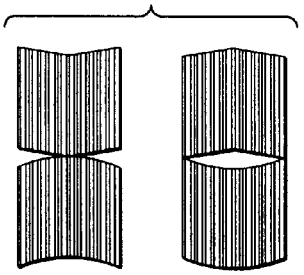
Figure 8H:
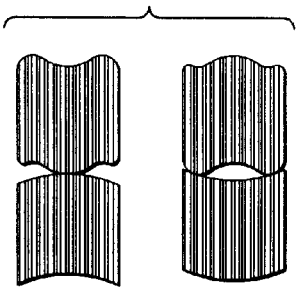
Figure 8I:
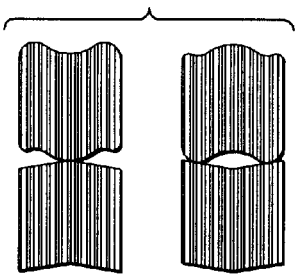

FIGS. 8A through 8I show examples of electromagnetics in accordance with the invention in which one end of an electromagnet is mated in a central location and the opposing end of the electromagnet is mated in the outer regions to provide a stable arrangement of parts. As is apparent, the three raised contact areas can be provided on either the magnetic core, the armature, or both. Particularly, FIG. 8A illustrates use of a forming die that provides rounding of one of the surfaces. This produces an arc or rounded contact area at one end and a triangular or generally pointed contact areas at an opposite end. FIG. 8B is similar to the embodiments of FIGS. 6 and 7 and illustrates generally pointed contact areas at both ends. FIG. 8C illustrates a rounded center contact area at one end and two rounded spaced apart contact areas at an opposite end. FIGS. 8B, 8E and 8F correspond to FIGS. 8A, 8B and 8C, respectively, for an electromagnet application in which the raised contact areas are provided on both an armature and a magnetic core. FIGS. 8G, 8H and 8I illustrate examples where raised contact areas are provided on both the armature and magnetic core with the configuration of the raised contact area being different on the armature relative to that of the magnetic core.

Thus, in accordance with the invention, an electromagnet utilizes an armature and magnetic core having mating surfaces adapted to provide three contact areas in a triangular configuration to provide minimal magnetic air gap and a stable interface when a coil is energized.

It can therefore be appreciated that a new and novel system and method for an electromagnetic formed contact surface has been described. It will be appreciated by those skilled in the art that, given the teaching herein, numerous alternatives and equivalent will be seen to exist which incorporate the disclosed invention. As a result, the invention is not to be limited by the foregoing exemplary embodiments, but only by the following claims.

I claim:

1. An electromagnetically actuable device having a magnetic core proximate an armature and a coil selectively energized to draw the armature to the magnetic core, comprising:

the armature and magnetic core each including legs having mating surfaces that provide three contact areas, where the mating surfaces contact one another between the corresponding legs of the armature and magnetic core, the three contact areas provided on the mating surfaces of the legs of the armature and magnetic core being in a triangular configuration to provide a stable interface when the coil is energized.

2. The electromagnetically actuable device of claim 1, wherein the mating surface of the magnetic core is planar and the mating surface of the armature includes three raised areas that are raised relative to a remainder of the armature mating surface to define three contact areas on the armature.

3. The electromagnetically actuable device of claim 1 wherein the mating surface of the armature is planar and the mating surface of the magnetic core includes three raised areas that are raised relative to a remainder of the magnetic core mating surface and defining the three contact areas.

4. The electromagnetically actuable device of claim 1 wherein the mating surface of the armature includes three raised areas that are raised relative to a remainder of the armature mating surface and the mating surface of the magnetic core includes three raised areas that are raised relative to a remainder of the magnetic core mating surface and opposite the armature three raised areas to define the three contact areas.

5. The electromagnetically actuable device of claim 1 wherein the magnetic core and the armature are formed of laminated magnetic steel.

6. The electromagnetically actuable device of claim 5 wherein the laminations in one of the magnetic core and the armature are shifted relative to one another to provide the three contact areas.

7. The electromagnetically actuable device of claim 1 wherein the three contact areas are rounded.

8. The electromagnetically actuable device of claim 1 wherein the three contact areas are pointed.

9. The electromagnetically actuable device of claim 1 wherein depth of the contact areas relative to a remainder of the mating surfaces is less than about 0.003 inches.

10. The electromagnetically actuable device of claim 1 wherein depth of the contact areas relative to a remainder of the mating surfaces is about 0.002 inches.

11. An electromagnetically actuable device comprising:

a base;

a magnetic core fixedly mounted to the base;

an armature movably mounted to the base proximate the magnetic core; and a coil fixedly mounted to the base and being selectively energized to draw the armature to the magnetic core, the armature and magnetic core each including leas having mating surfaces that provide three contact areas, where the mating surfaces contact one another between the corresponding lees of the armature and the magnetic core, the three contact areas provided on the mating surfaces of the leas of the armature and magnetic core being in a triangular configuration to provide a stable interface when the coil is energized.

12. The electromagnetically actuable device of claim 11 wherein the mating surface of the magnetic core is planar and the mating surface of the armature includes three raised areas that are raised relative to a remainder of the armature mating surface to define three contact areas on the armature.

13. The electromagnetically actuable device of claim 11 wherein the mating surface of the armature is planar and the mating surface of the magnetic core includes three raised areas that are raised relative to a remainder of the magnetic core mating surface and defining the three contact areas.

14. The electromagnetically actuable device of claim 11 wherein the mating surface of the armature includes three raised areas that are raised relative to a remainder of the armature mating surface and the mating surface of the magnetic core includes three raised areas that are raised relative to a remainder of the magnetic core mating surface and opposite the armature three raised areas to define the three contact areas.

15. The electromagnetically actuable device of claim 11 wherein the magnetic core and the armature are formed of laminated magnetic steel.

16. The electromagnetically actuable device of claim 15 wherein the laminations in one of the magnetic core and the armature are shifted relative to one another to provide the three contact areas.

17. The electromagnetically actuable device of claim 11 wherein the three contact areas are rounded.

18. The electromagnetically actuable device of claim 11 wherein the three contact areas are pointed.

19. The electromagnetically actuable device of claim 11 wherein depth of the contact areas relative to a remainder of the mating surfaces is less than about 0.003 inches.

20. The electromagnetically actuable device of claim 11 wherein depth of the contact areas relative to a remainder of the mating surfaces is about 0.002 inches.

* * * * *